US005104263A

United States Patent [19]

Shibahara et al.

[11] Patent Number: 5,104,263

[45] Date of Patent: Apr. 14, 1992

[54] UNDERGROUND PIPE FOR A THRUST BORING METHOD AND A CONNECTING CONSTRUCTION OF THE UNDERGROUND PIPE FOR THE SAME

[75] Inventors: Shigeyoshi Shibahara, Shiga; Takahiro Morimoto, Muko, both of Japan

[73] Assignees: Sekisui Kagaku Kogyo Kabushiki Kaisha, Osaka; C.I. Kasei Co, Ltd., Tokyo, both of Japan

[21] Appl. No.: 476,448

[22] PCT Filed: Oct. 5, 1989

[86] PCT No.: PCT/JP89/01022

§ 371 Date: Jul. 31, 1990

§ 102(e) Date: Jul. 31, 1990

[87] PCT Pub. No.: WO90/04082

PCT Pub. Date: Apr. 19, 1990

[30] Foreign Application Priority Data

Oct. 5, 1988 [JP] Japan ..... 63-251631
Apr. 14, 1989 [JP] Japan ..... 1-44429[U]

[51] Int. Cl.[5] ..... E02F 5/10
[52] U.S. Cl. ..... 405/184; 405/154
[58] Field of Search ..... 405/184, 154, 157, 142, 405/138

[56] References Cited

U.S. PATENT DOCUMENTS 1,200,119 10/1916 Keeler ..... 405/184 X
1,762,766 6/1930 Garay .
2,211,223 8/1940 Woods .
2,424,027 7/1947 Gist .
3,049,382 8/1962 Ell .
3,981,359 9/1976 Fortenberry .
4,091,630 5/1978 Nemoto et al. ..... 405/184
4,681,161 7/1987 Arterbury et al. .
4,815,896 3/1989 Fox et al. ..... 405/157 X
4,874,268 10/1989 Akesaka ..... 405/184

FOREIGN PATENT DOCUMENTS

0217995A2 4/1987 European Pat. Off. .
2501273 7/1976 Fed. Rep. of Germany .
8535786.3 8/1988 Fed. Rep. of Germany .
58-120996 7/1983 Japan .
200303 7/1923 United Kingdom .
1517872 7/1978 United Kingdom .
2141161A 12/1984 United Kingdom .

*Primary Examiner*—Dennis L. Taylor
*Assistant Examiner*—J. Russell McBee
*Attorney, Agent, or Firm*—Armstrong, Nikaido, Marmelstein, Kubovcik & Murray

[57] ABSTRACT

An underground pipe for a thrust boring method whereby the underground pipe is thrust through the ground, one being connected to another, while boring a horizontal tunnel through the ground. This invention also relates to a connecting construction of the underground pipe for the thrust boring method. The underground pipes are connected with each other directly or by means of a collar. A plurality of projecting lines are formed either on the collar or the pipe body. The lines extend continuously or discontinuously in the axial direction of the pipe with suitable spacing provided therebetween in the circumferential direction of the pipe.

19 Claims, 5 Drawing Sheets

UNDERGROUND PIPE FOR A THRUST BORING METHOD AND A CONNECTING CONSTRUCTION OF THE UNDERGROUND PIPE FOR THE SAME

TECHNICAL FIELD

The present invention relates to an underground pipe for a thrust boring method whereby the underground pipe is thrust through the ground, one being connected to another, while boring a horizontal tunnel through the ground, and to a connecting construction of the underground pipe for the thrust boring method.

BACKGROUND ART

Underground pipes such as sewer pipes, water-supply pipes, cable protective pipes, etc., are installed using, for example, a thrust boring method. The thrust boring method, as disclosed in Japanese Laid-Open Patent Publication No. 58-120996, is such that a vertical hole is bored into the ground from the wall of which a pipe having a drilling cutter at the forward end thereof is pushed into the ground to be thrust through it in the horizontal direction for installation of the pipe while the drilling cutter is boring a horizontal tunnel of a diameter slightly larger than that of the pipe. To the rear end of the pipe pushed into the ground, a new pipe to be installed is connected and pushed into the ground to be thrust through the horizontal tunnel.

The thrust boring method disclosed in the above Japanese Publication uses a pipe having a collar on the end thereof facing opposite to the thrusting direction, the collar being used to connect the next pipe.

In the case of the underground pipe disclosed in the above Japanese Publication, since the collar has a larger diameter than that of the pipe body excluding the collar, a large gap is created between the horizontal tunnel and the outer surface of the pipe. Therefore, the soil in the tunnel may fall and accumulate on the bottom of the tunnel while the pipe is being thrust therethrough. If the soil accumulates on the bottom of the tunnel, the collar of the pipe that is pushed into the tunnel thereafter may override the soil, causing the thrusting direction of the pipe to turn upward and resulting in a deviation from the desired direction. This may also result in the bending of the pipe being thrust. Also, since a gap of the size equivalent to the difference between the outer diameter of the collar and the outer diameter of the pipe is left around the pipe installed underground, the ground may sink by the depth equivalent to the size of the gap if the ground is not firm enough. In the case of using a pipe joint to join the pipes being thrust through the tunnel, if the pipe joint has a larger diameter than that of the pipe, the same problem as mentioned above will occur.

As a solution to such a problem, in the case of a thick wall pipe such as a Hume pipe, the outer circumferential surface of the end portion of the pipe on which the collar is to be fitted may be ground down to sufficient depth so as not to allow the collar fitted thereon to protrude outwardly beyond the outer surface of the pipe body. However, in the case of a plastic pipe with a thin wall thickness such as a PVC pipe, the outer circumferential surface of the end portion of the pipe on which the collar is to be fitted can only be ground down to a maximum of 40% of its wall thickness if the strength of the end portion of the pipe on which the collar is fitted is to be retained. Therefore, the thickness of the collar to be fitted on the ground down end portion of the pipe should be, at maximum, approximately 40% of the wall thickness of the pipe if the collar is not allowed to protrude beyond the outer circumferential surface of the pipe body. If the collar is also made of synthetic resin like the pipe, the collar cannot be made sufficiently strong with this thickness, and may break when the pipe is thrust into the ground. It can be considered to provide a collar made of metal, or other material having excellent stiffness, with a separate construction from that of the pipe. However, when such a metal collar is fitted onto the pipe made of synthetic resin, it is extremely difficult to quickly bond them together for sufficient water tightness, and therefore, it is not possible to employ such a construction for the underground pipe for the thrust boring method.

In view of the above-mentioned problems of the prior art, it is an object of the present invention to provide an underground pipe for a thrust boring method and a connecting construction of the underground pipe for the thrust boring method, wherein there is no possibility of the thrusting direction being altered or the pipe being bent because of the buildup of soil on the bottom of a horizontal tunnel when the pipe is thrust through the tunnel, and also, the pipe itself is sufficiently strong so that no breakage will occur.

DISCLOSURE OF THE INVENTION

The connecting construction of underground pipes for the thrust boring method according to the present invention is a connecting construction for connecting the underground pipes that are installed by the thrust boring method by which the underground pipes are thrust one after another through the ground, one being connected to another by means of a collar along the thrusting direction, while boring a horizontal tunnel for themselves through the ground, the connecting construction being provided on each end of the underground pipe where it is joined to the end of another underground pipe, and comprising a fitting portion having an outer diameter smaller than a given outer diameter of the body of the pipe excluding each end portion thereof, and a collar fitted around the fitting portions of the connected pipes and having numerous projecting lines projecting outwardly beyond the outer circumferential surface of the body of each pipe and extending continuously or discontinuously in the axial direction of the pipe with suitable spacing provided therebetween in the circumferential direction of the pipe.

In a preferred embodiment, the underground pipe is made of synthetic resin, the difference between the outer diameter of the underground pipe and the outer diameter of the fitting portion thereof being less than approximately 40% of the wall thickness of the body of the underground pipe.

In a preferred embodiment, the thickness of the portion of the collar where the projecting lines are not formed is approximately equal to the difference between the outer diameter of the body of the underground pipe and the outer diameter of the fitting portion thereof.

In a preferred embodiment, each projecting line formed on the collar has a triangularly shaped cross section.

In a preferred embodiment, the total cross sectional area of all the projecting lines formed on the collar is within the range of 6 to 20% of the total cross sectional area of the collar.

In a preferred embodiment, the projecting lines formed on the collar is approximately 50 or less in number when counted in the circumferential direction of the collar.

In a preferred embodiment, each projecting line formed on the collar has a projecting height gradually decreasing toward one end thereof.

In a preferred embodiment, the projecting lines are formed discontinuously in the axial direction of the collar, the breaks in the neighboring lines being offset from each other when viewed in the circumferential direction of the collar.

In a preferred embodiment, the projecting lines disposed on the collar are formed in such a cross sectional shape, when taken along the axial direction of the collar, as slopes down toward the ends with the middle portion projecting upward.

In a preferred embodiment, the axially middle portion of the collar is provided with an inwardly projecting protrusion against which the fitting portion fitted in the collar abuts.

In a preferred embodiment, the projecting lines are formed only on the lower half portion of the collar, the outer surface of the upper half portion thereof protruding outwardly beyond the outer circumferential surface of the pipe body.

The underground pipe for the thrust boring method according to the present invention is thrust one after another through the ground, each connected to another along the thrusting direction, while boring a horizontal tunnel through the ground, and comprises a plurality of projecting lines which are formed at least on the lower half portion of the pipe body excluding the end portions to be connected and which extend continuously or discontinuously in the axial direction of the pipe with suitable spacing provided therebetween in the circumferential direction of the pipe.

In a preferred embodiment, one end of the pipe is provided with an inserting section, the other end thereof with a socket section into which the inserting section is inserted.

In a preferred embodiment, each end of the pipe is provided with a socket section, the socket sections (of the pipes to be joined together) abutting against each other along the thrusting direction being fastened together with a collar.

In a preferred embodiment, the projecting lines have a triangularly shaped cross section.

In a preferred embodiment, the projecting lines have a circularly shaped cross section.

In a preferred embodiment, the projecting lines are formed on both the upper and lower portions of the pipe body.

In a preferred embodiment, the projecting lines are formed only on the lower half portion of the pipe body.

In a preferred embodiment, the projecting lines are discontinuously formed in the axial direction of the pipe, the breaks in the neighboring lines being offset from each other when viewed in the circumferential direction of the pipe.

Thus, with the connecting construction of the underground pipe for the thrust boring method according to the present invention, when the pipes joined with a collar is pushed through a horizontal tunnel, the soil accumulated in the horizontal tunnel is caught into the space between the projecting lines formed on the collar, thereby preventing the thrusting direction of the pipes from being appreciably altered upward. Furthermore, the collar is provided with excellent flexural and compressive strength because of the projecting lines formed thereon, and there is no possibility of the collar breaking when the pipes are pushed through the ground.

Also, when the upper half portion of the collar is made thicker, in wall thickness without forming projecting lines thereon, the collar will have further flexural and compressive strength, which will not only eliminate the possibility of the collar breaking when the pipes are pushed through the ground, but also serve to sufficiently resist the bending force acting to cause the installed underground pipes to protrude upwardly.

Furthermore, the underground pipe for the thrust boring method according to the present invention is so constructed that if soil falls from the inner walls of the horizontal tunnel when the pipe is pushed through the tunnel, the falling soil will be blocked by the projecting lines from falling down to the bottom of the tunnel, thereby eliminating the possibility of the thrusting direction of the pipe being altered with the socket portion or collar overriding the soil accumulated on the bottom of the tunnel. Moreover, since the body of the pipe has a construction that gives excellent flexural and compressive strength because of the provision of the projecting lines, there is no possibility of the pipe breaking while being pushed through the ground.

BRIEF DESCRIPTION OF DRAWINGS

This invention may be better understood and its numerous objects and advantages will become apparent to those skilled in the art by reference to the accompanying drawings as follows.

BEST MODE FOR CARRYING OUT THE INVENTION

Description will now be given dealing with the examples of the present invention.

EXAMPLE 1

Figure 1:
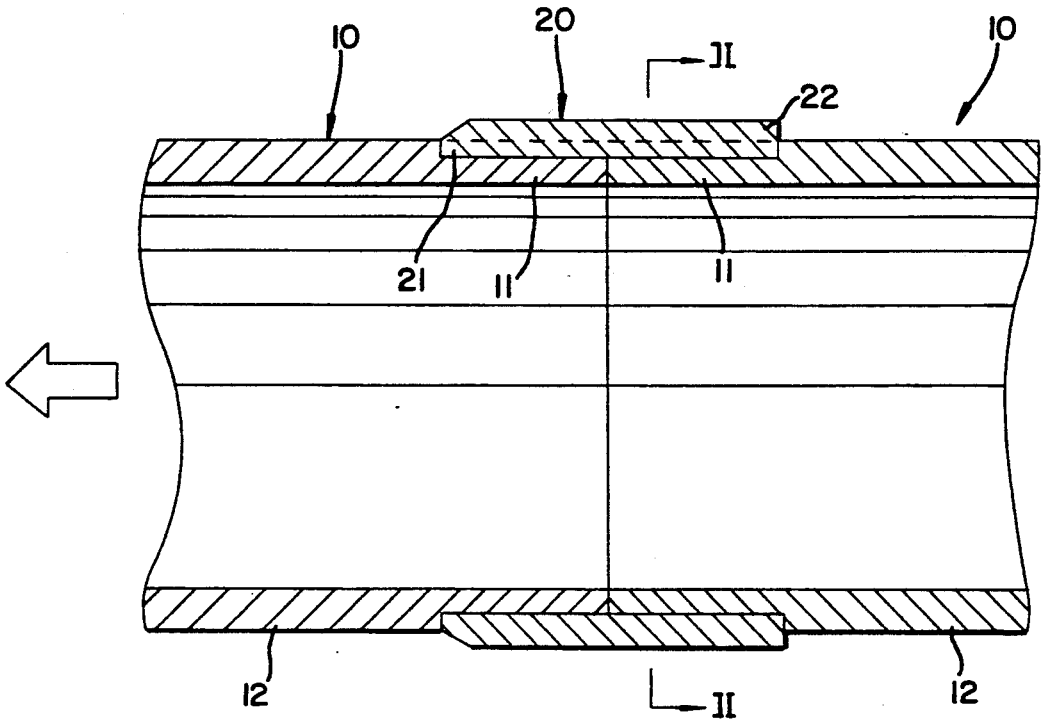
FIG. 1 is a cross sectional view of one example of the connecting construction of an underground pipe for a thrust boring method according to the present invention.
Figure 2:
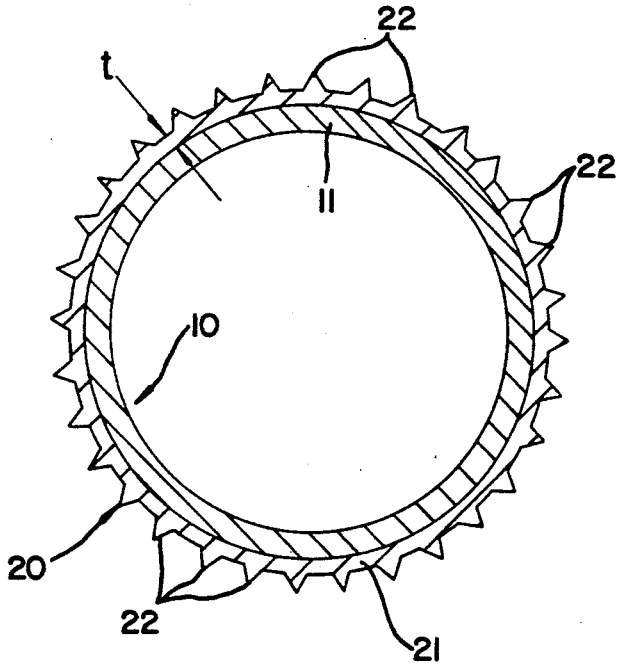
FIG. 2 is a cross sectional view taken along the line II–II in FIG. 1.

The connecting construction of the underground pipe for the thrust boring method according to the present invention is constituted of, as shown in FIGS. 1 and 2, each end portion of a pair of underground pipes 10 and 10 and a collar 20. Each pipe 10 is made, for example, of synthetic resin such as PVC, and comprises fitting portions 11 provided at both ends thereof and a body 12 excluding the fitting portions 11 and having a uniform outer diameter. Each fitting portion 11 has an outer diameter smaller than that of the pipe body 12. The pair of pipes 10 are joined together with the end faces of their fitting portions 11 abutting against each other.

The collar 20 is also made of the same synthetic resin as that of the pipe 10, and is fitted around both fitting portions 11 and 11 of the pair of joined pipes 10. Formed on the outer surface of the cylindrically shaped body 21 of the collar 20 are numerous projecting lines 22, 22, . . . projecting outwardly and extending continuously in the axial direction with suitable spacing provided between them in the circumferential direction. The wall thickness of the collar body 21 is equal to the difference between the outer diameter of the pipe body 12 and the outer diameter of the fitting portion 11 so that the outer circumferential surface of the collar body 21 does not protrude outwardly beyond the outer circumferential surface of the body 12 of the pipe 10. On the other hand, the projecting lines 22 formed on the outer surface of the collar 20 protrude outwardly beyond the outer circumferential surface of the body 12 of the pipe 10.

Each projecting line 22 has a cross section of a triangular shape gradually thinning toward its tip, and the end of the projecting line 22 facing the thrusting direction is chamfered in a tapered shape.

The longitudinal length of the collar 20 is slightly shorter than the combined longitudinal length of the two fitting portions 11 so as to allow their end faces to firmly abut against each other when joined together.

Figure 3:
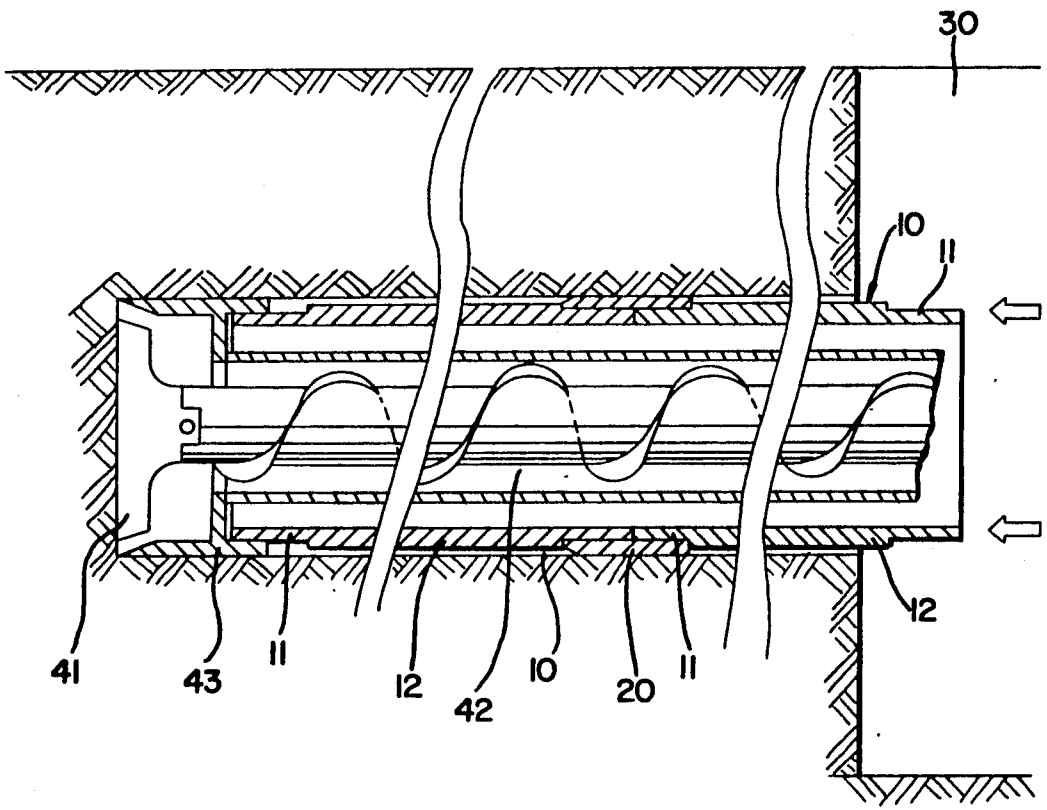
FIG. 3 is a diagram illustrating a thrust boring method using the connecting construction of the present invention.

The installation of the underground pipes by the thrust boring method proceeds in the following manner. First, as shown in FIG. 3, a vertical hole 30 is bored at each end of the distance along which the underground pipes 10 are to be laid, and a driving machine such as a jack is placed in the vertical hole 30 at one end. In this situation, a leading pipe 43 with a drilling cutter 41 installed therein is pushed into the ground from the wall of the vertical hole 30, and the fitting portion 11 at the forward end of the pipe 10 is then fitted onto the leading pipe 43.

Next, the fitting portion at the rear end of the underground pipe 10 is coupled to the driving machine.

In this situation, the drilling cutter 41 is put into operation, and the whole length of the leading pipe 43 is pushed into the ground by the force of the driving machine. The drilling cutter 41 drills into the ground to form a horizontal tunnel, while the driving machine pushes the leading pipe 43 into the thus formed horizontal tunnel. When the leading pipe 43 is pushed in, the pipe 10 fitted on the leading pipe 43 is also pushed in. The soil excavated by the drilling cutter 41 is discharged into the vertical hole 30 by means of a screw conveyer 42 installed inside the pipe 10. The outer surface of the body 12 of the pipe 10 that is being thrust through the horizontal tunnel moves in a sliding way along the inner surface of the horizontal tunnel.

When the pipe 10 has been pushed into the horizontal tunnel leaving the fitting portion 11 at its rear end exposing outside the tunnel, the collar 20 is fitted onto the fitting portion 11. At this time, the collar 20 is fitted onto the fitting portion 11 in such a way that the tapered end of each of the projecting lines 22 formed thereon faces the thrusting direction. Then, the fitting portion 11 at the forward end of the next pipe 10 is fitted into the collar 20 to be joined to the first pipe 10. At this time, the fitting portion 11 of each of the pipes 10 is bonded to the collar 20 with an adhesive to provide a water-tight seal. The pipe 10 thus joined to the first pipe 10 is then pushed into and thrust through the horizontal tunnel by means of the driving machine. Thereafter, in the same manner as described above, pipes 10 are joined together and pushed through the horizontal tunnel one after another till the pipeline of the specified length is installed.

The connection of the pipes is not limited to the above mentioned procedure. Alternatively, a pipe with the collar 20 already bonded to its rear end may be pushed into the ground, the next pipe then being fitted into and bonded to the collar 20.

When the pipes 10 joined together with the collar 20 are thrust through the horizontal tunnel, if soil is accumulated on the bottom of the tunnel, the soil will be caught into the space between the projecting lines 22 formed on the collar 20, thereby preventing the thrusting direction of the collar 20 from being altered upward.

The wall thickness t (see FIG. 2) of the body 21 of the collar 20 should be approximately equal to the difference between the outer diameter of the body 12 of the pipe 10 and the outer diameter of the fitting portion 11. The difference should be less than approximately 40% of the wall thickness of the pipe body 12 if the pipe 10 is made of synthetic resin such as PVC. If the difference between the wall thickness of the pipe body 12 and the wall thickness of the fitting portion 11 becomes greater than that mentioned above, the wall thickness of the fitting portion 11 will not be sufficient and the fitting portion 11 may buckle when the pipes 10 are thrust through the horizontal tunnel. Therefore, the wall thickness t of the collar body 21 should be approximately 40% of the wall thickness of the body 12 of the pipe 10. For example, in the case of a PVC pipe VU250, the wall thickness t should be 8.4 mm$\times$0.4=3.5 mm, approximately.

Since the projecting lines 22 formed on the collar 20 serve to enhance the axial strength of the whole construction of the collar 20, there is no possibility of the collar 20 breaking when the pipes 10 with the collar 20 fitted on the fitting portions thereof are thrust through the horizontal tunnel. The number of the projecting lines 22, the spacing to be provided therebetween etc., are so determined as to provide sufficient axial strength to the collar 20.

The total cross sectional area of the projecting lines 22 formed on the collar 20 and having a triangularly shaped cross section should be within the range of 6 to 20% of the total cross sectional area of the whole construction of the collar 20.

The dimensional ratio of the circumferential spacing (pitch) between the projecting lines to the width of the base of the projecting lines 22 should be within the range of 1:1 to 3:1. If the base width of the projecting lines 22 is made narrower and the height higher, synthetic resin shrinkage (distortion caused in the resin when released from the mold) and other problems will result when the collar 20 is injection-molded. The number of the parallel projecting lines 22 as counted in the circumferential direction of the collar 20 is so determined as to provide the specified strength to the collar 20, as mentioned above. A greater number of the projecting lines 22, if provided on the collar 20, may cause its thrusting direction to be altered upward because of the soil accumulated on the bottom of the horizontal tunnel when the collar 20 and the underground pipes 10 joined together are thrust through the tunnel. As a result, the installed underground pipes 10 will be caused to curve in such a way as to protrude upwardly. The inventors of the present invention conducted an experiment to examine the relationship between the number of the parallel projecting lines 22 as counted in the circumferential direction of the collar 20 and the amount of deflection of the installed underground pipes. In this experiment, PVC pipes VU250 were used as the underground pipes. The projecting lines 22 on the collar 20 were triangular in cross section, the height being approximately equal to 40% (approximately 3.5 mm) of the wall thickness the body 12 of the underground pipe 10 and the width approximately D/2 Sin 6° with respect to the outer diameter D of the underground pipe. The condition of the soil in which the underground pipes were laid was a sandy soil containing volcanic ashes, the N value being 15 to 20, and the underground pipes were laid with the top surface thereof positioned 4.5 m below the ground surface. The groundwater level was 1.8 m below the ground surface. The pipes were installed by the thrust boring method using collars having 60, 40, and 30 projecting lines, respectively, and the amount of deflection of the installed underground pipes was measured at intervals of 10 m along the length of 50 m. The results obtained are shown in Table 1. As a point of reference, Table 1 also shows the measured results of the amount of deflection of the pipes which were installed by the thrust boring method using a cylindrically shaped collar having a larger outer diameter than that of the installed pipe body as disclosed in Japanese Laid-Open Patent Publication No. 58-120966. In the Table, the sign "—" indicates that the experiment was discontinued.

TABLE 1

| Number of projecting lines on collar | Thrusting length | | | | |
|---|---|---|---|---|---|
| | 10 m | 20 m | 30 m | 40 m | 50 m |
| 60 | 20 mm | 25 mm | 50 mm | — | — |
| 40 | 15 mm | 20 mm | 20 mm | 26 mm | — |
| 30 | 5 mm | 5 mm | 10 mm | 10 mm | 15 mm |
| Prior art (Laid-Open Publication 58-120996) | 15 mm | 45 mm | — | — | — |

As is apparent from the above results, the desired number of the projecting lines formed on the collar is approximately 50 or less.

Figure 4:
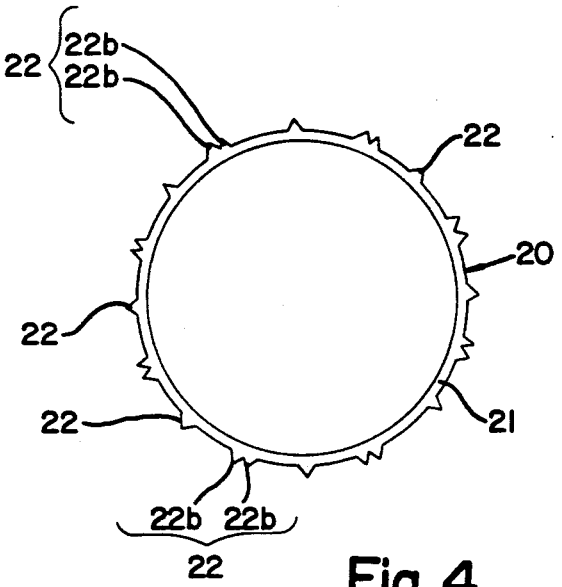
FIG. 4 is a front sectional view showing another example of the collar used in the connecting construction of the underground pipe according the present invention.
Figure 5:
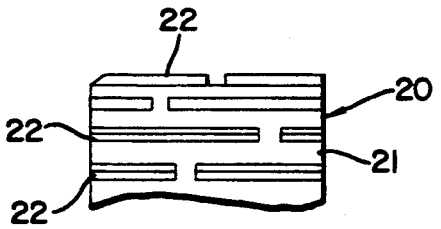
FIG. 5 is a diagram illustrating the main part of still another example of the collar.
Figure 6:
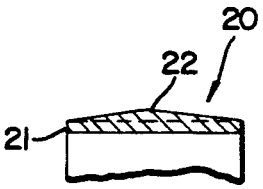
FIGS. 6 and 7 are cross sectional views respectively illustrating the main parts of yet another different examples of the collar.
Figure 7:
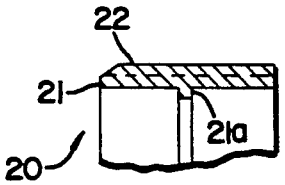

The spacing between the projecting lines 22 does not have to be equal, and, as shown in FIG. 4, a pair of projecting lines **22*b* and 22*b* each triangular in cross section may be formed closely adjacent to each other without spacing provided in the circumferential direction of the collar. Furthermore, the projecting lines 22 do not have to be continuously formed in the axial direction of the collar, but may be discontinuously formed in the axial direction thereof as shown in FIG. 5. In this case, if the projecting lines 22 are disposed in such a way that the breaks in the neighboring lines are offset from each other when viewed in the circumferential direction of the collar, the flexural strength of the collar does not drop. Also, as shown in FIG. 6, the projecting lines 22 may be formed in such a cross sectional shape, when taken along the axial direction of the collar 20, as slopes down toward the ends with the middle portion projecting most outwardly. Further, as shown in FIG. 7, an annular protrusion 21 a against which the end face of the fitting portion 11 of each of the pipes 10 abuts may be provided on the inner circumferential surface in the middle part of the collar body 21. In the above embodiment, the cross sectional shape of the projecting lines 22** is triangular, but the shape is not limited to a triangle, but may be semicircular, semi-ellipsoidal, rectangular, etc.

Figure 8:
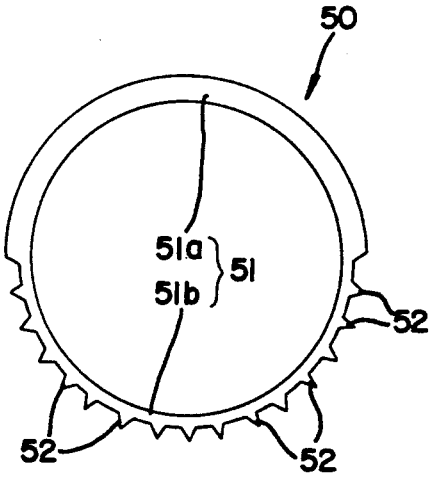
FIG. 8 is a front sectional view of a still further example of the collar used in the connecting construction of the present invention.

Also, a collar having the construction shown in FIG. 8 may be used in the connecting construction of the underground pipe of the present invention. The lower half portion **51*b* of the body 51 of the collar 50 has a wall thickness equal to the difference between the outer diameter of the body 12 of the pipe 10 and the outer diameter of the fitting portion 11, as in the case of the collar 20 shown in FIGS. 1 and 2, and is provided with outwardly projecting and axially extending numerous projecting lines 52, 52, . . . with suitable spacing provided therebetween. The upper half portion 51*a* of the collar body 51 has a uniform wall thickness equal to the wall thickness of the lower half portion 51*b* plus the height of the projecting lines 52 formed on the lower half portion 51*b*. Therefore, when the collar 50 is fitted on the fitting portion 11 of the pipe 10, the outer surface of the upper half porion 51*a* of the collar body 51 protrudes outwardly beyond the outer surface of the body 12 of the pipe 10. The upper half portion 51*a* of the collar body 51** is chamfered in a tapered shape at its end portion facing the thrusting direction.

When the pipes 10 are installed by the thrust boring method using the above mentioned collar 50, the soil accumulated on the bottom of the horizontal tunnel is caught into the space between the projecting lines 52 formed on the lower half portion **51*b* of the body 51 of the collar 50, thereby preventing the thrusting direction of the underground pipes 10 from being altered upward. Furthermore, the thick wall thickness in the upper half of the collar 50 provides greater flexural strength to the collar 50. As a result, the installed underground pipes are prevented from curving in such a way as to protrude upwardly. The number of the projecting lines 52 formed on the collar 50 should be approximately equal to that of the projecting lines 22 formed on the lower half of the previously mentioned collar 20. Also, the shape, dimensions, etc., of the projecting lines 52 should be the same as those described with reference to the foregoing example of the collar 20**.

In the above example, the description has been dealing with the pipes and collars made of plastic, but the present invention is not restricted to the plastic pipes and collars. Pipes of cast iron, concrete, or other materials may be connected using a collar of cast iron, concrete, or other materials.

EXAMPLE 2

Figure 9:
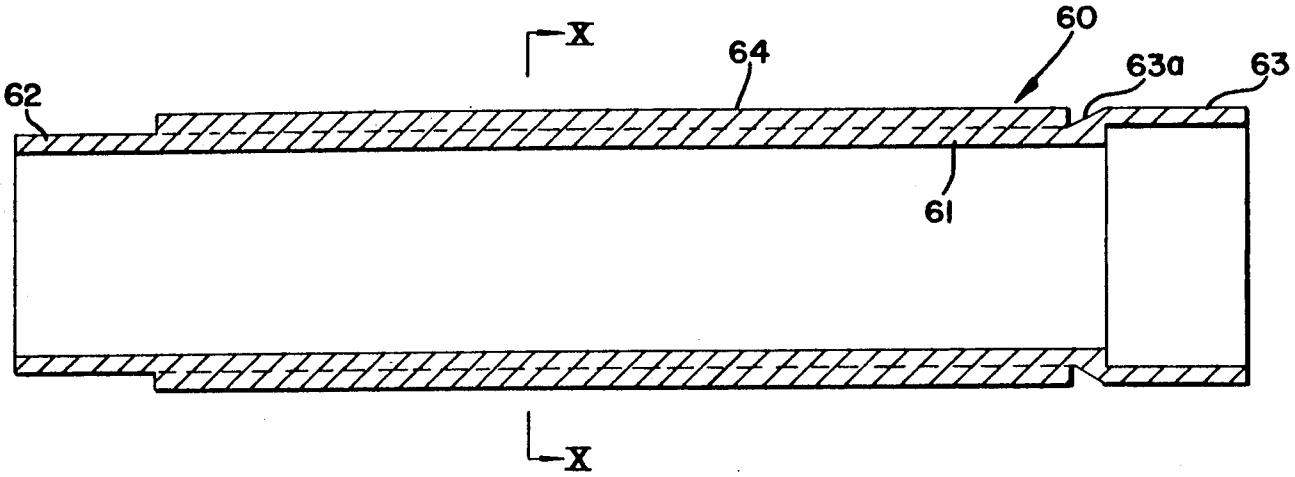
FIG. 9 is a cross sectional view showing one example of the underground pipe for the thrust boring method according to the present invention.
Figure 10:
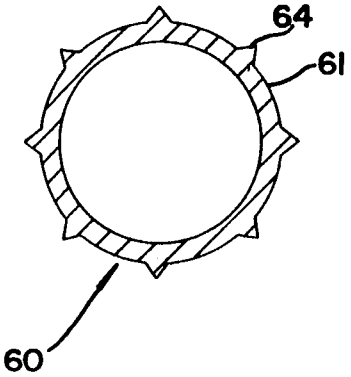
FIG. 10 is a cross section view taken along the line X—X in FIG. 9.

As shown in FIGS. 9 and 10, the underground pipe 60 for the thrust boring method according to the present invention is made, for example, of synthetic resin such as PVC and comprises an inserting section 62 provided at one end thereof, a socket section 63 provided at the other end, and a pipe body 61 excluding the inserting section 62 and the socket section 63. Formed on the outer surface of the pipe body 61 are a plurality of projecting lines 64 molded integrally with the pipe body 61 and extending in the axial direction of the pipe with equal spacing provided therebetween in the circumferential direction of the pipe. Each projecting line 64 has a cross section of a triangular shape gradually thinning toward its tip, and is continuously formed on the outer surface of the pipe body 61 along the entire longitudinal direction of the pipe. The tip of each projecting line 64 is positioned on a circle having a diameter approximately equal to or slightly larger than the inner diameter of the horizontal tunnel through which the underground pipes 60 are pushed.

The inner and outer diameters of the inserting section 62 are respectively equal to the inner and outer diameters of the portion of the pipe body 61 between the projecting lines 64, and the inserting section 62 is provided continuously with the pipe body 61.

The socket section 63 provided at the other end of the pipe body 61 has an outer diameter equal to the diameter of the circle on which the tip of each projecting line 64 formed on the outer surface of the pipe body 61 is positioned, and is provided with a tapered surface 63*a* gradually sloping down toward the pipe body 61 to connect continuously with the outer surface of the pipe body 61. The inner surface of the socket section 63 is formed so that approximately the entire length of the inserting section 62 at the other end of the pipe body 61 can be inserted, and at the innermost end of the socket section 63, a step is formed against which the end face of the inserting section 62 abuts.

The underground pipes of this example are installed by the thrust boring method in the same manner as the underground pipes of the foregoing example. As shown in FIG. 3, a leading pipe 43 with a drilling cutter 41 installed therein is pushed into the ground horizontally from the wall of a vertical hole 30, and the inserting section 62 at one end of the underground pipe 60 is fitted into the leading pipe 43.

Then, the socket section 63 provided at the other end of the underground pipe 60 is coupled to a driving machine (not shown).

In this situation, the drilling cutter 41 is put into operation, and the whole length of the leading pipe 43 is pushed into the ground by the force of the driving machine. The drilling cutter 41 drills into the ground to form a horizontal tunnel, while the driving machine pushes the leading pipe 43 into the thus formed horizontal tunnel. When the leading pipe 43 is pushed in, the underground pipe 60 inserted in and fitted to the leading pipe 43 is also pushed in. The soil excavated by the drilling cutter 41 is discharged into the vertical hole 30 by means of a screw conveyer 42 installed inside the underground pipe 60. The underground pipe 60 is thrust through the horizontal tunnel, the tip of each projecting line 64 formed on the outer surface of the pipe body 61 moving in such a way as to slide along the inner surface of the horizontal tunnel.

When the underground pipe 60 is thrust through the horizontal tunnel, soil falls from the walls of the tunnel into the gap between the walls of the tunnel and the outer surface of the pipe body 61, but the projecting lines 64 that contact slidingly with the walls of the tunnel serve to block the soil from falling further down, thereby preventing the soil from accumulating on the bottom of the tunnel.

When the pipe 60 has been inserted into the horizontal tunnel leaving the socket section 63 at its rear end exposing outside the tunnel, the inserting section 62 of the next underground pipe 60 of the same shape as the first underground pipe 60 already pushed into the tunnel is inserted into the socket section 63 for joining together. At this time, the socket section 63 of the first underground pipe 60 and the inserting section 62 of the next underground pipe 60 inserted into the socket section 63 are bonded together with an adhesive to provide a water-tight seal. The pipe 60 thus joined to the first pipe 60 is then pushed into and thrust through the horizontal tunnel by means of the driving machine. Thereafter, in the same manner as described above, pipes 60 are joined together and pushed through the horizontal tunnel one after another till the pipeline of the specified length is installed.

Figure 11:
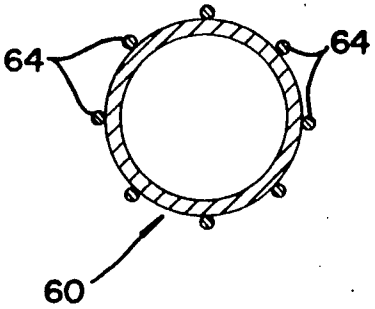
FIG. 11 is a front sectional view of another example of the underground pipe of the present invention.

The cross sectional shape of each projecting line 64 formed on the outer surface of the body 61 of the pipe 60 is not limited to a triangle, but may be circular, for example, as shown in FIG. 11. The cross sectional shape may also be quadrangular, semicircular, hollow circular, etc.

The projecting lines 64 do not have to be disposed on the entire circumferential surface of the pipe body, but may only be formed at least on the lower half thereof. Further, each projecting line 64 does not have to be formed continuously along the entire longitudinal length of the pipe body 61, but may be formed discontinuously along the entire longitudinal length of the pipe body 61, for example, with the discontinuously formed lines offset from each other in the middle part of the pipe body 61 when viewed in the circumferential direction of the pipe. Also, the projecting lines 64 do not have to be molded integrally with the pipe body 61 from the same material, but projecting lines 64 made of different material from that of the pipe body 61 may be fixed with an adhesive or the like to the pipe body made, for example, of glass fiber reinforced plastic.

Figure 12:
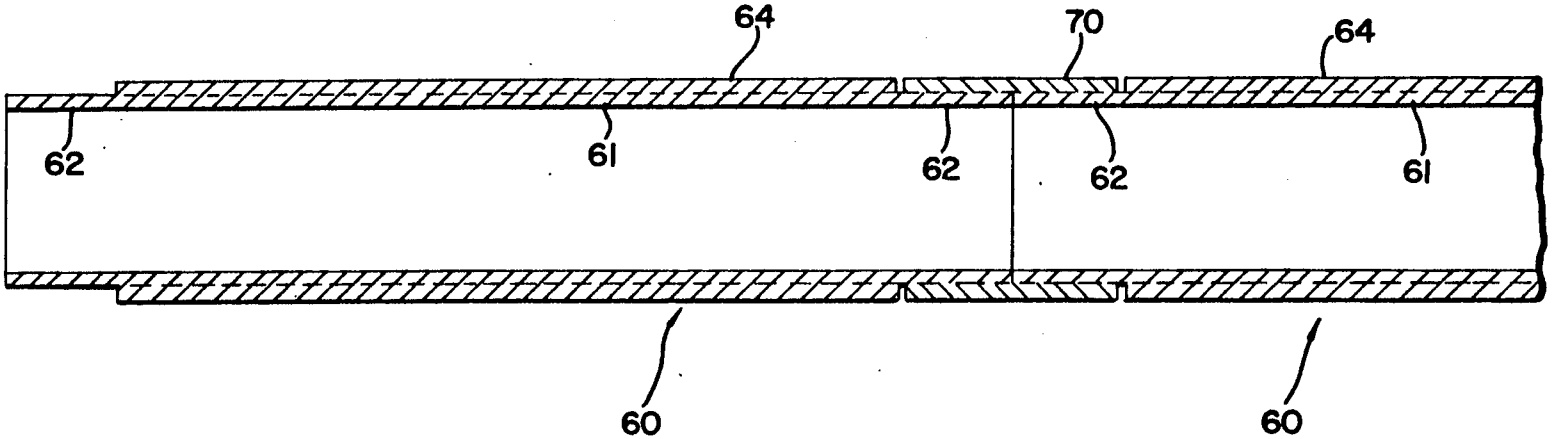
FIG. 12 is a cross sectional view of yet another example of the underground pipe of the present invention.

Furthermore, the underground pipe of the present invention is not limited to the construction of the above example in which the pipe body 61 has the inserting section 62 provided at one end thereof and the socket section 63 at the other end, but may be so constructed as to have the inserting section 62 at each end thereof as shown in FIG. 12. In this case, as shown in FIG. 12, a cylindrically shaped collar 70 produced separately from the underground pipe 60 is used to connect the underground pipes 60 together. The collar 70 has an outer diameter approximately equal to the diameter of the circle on which the tip of each projecting line 64 formed on the outer surface of the pipe body 61 is positioned, and an inner diameter approximately equal to or slightly larger than the inner diameter of the inserting section 62 so as to allow the insertion of the inserting section 62 of the underground pipe 60. The longitudinal length of the collar 70 is determined so that the inserting sections 62 are inserted into the collar 70 and abut against each other in the center of the collar 70 with part of each inserting section 62 exposed from the collar 70.

As in the case of the above example, the underground pipes of such construction are installed in such a way that the collar 70 is fitted onto the inserting section 62 at the rear end of the first underground pipe 60 already pushed into the horizontal tunnel, the inserting section 62 of the next underground pipe 60 then being inserted for joining together. The collar 70 may be previously fitted onto the rear end of the underground pipe 60.

In the above example also, the description has been dealing with the underground pipes made of synthetic resin, but the material to be used is not limited to synthetic resin. For example, cast iron or concrete may be used for the underground pipes.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

We claim:

1. A connecting construction for connecting underground pipes that are installed by a thrust boring method by which the underground pipes are thrust one after another through the ground, pipes being connected to one another along a thrusting direction while boring a horizontal tunnel for the pipes through the ground, said connecting construction being provided on each end of the underground pipe where each pipe is joined to an end of another underground pipe, said connecting construction comprising:

each underground pipe having a body portion of a given outer diameter, and a fitting portion having an outer diameter smaller than said given outer diameter of the body portion; and a collar for joining two pipes fitted around each fitting portion of connected underground pipes, said collar having a collar body, and a plurality of projecting lines projecting outwardly from the collar body extending one of continuously and discontinuously in an axial direction of the pipe with suitable spacing provided therebetween in a circumferential direction of the pipe wherein an outer circumferential surface of the collar body does not protrude outwardly beyond an outer circumferential surface of the body portion of said pipe.

2. A connecting construction according to claim 1, wherein said underground pipe is made of synthetic resin, a difference between the given outer diameter of said body portion and the outer diameter of the fitting portion thereof being less than approximately 40% of a wall thickness of the body portion of said underground pipe.

3. A connecting construction according to claim 1, wherein a thickness of said collar body where the projecting lines are not formed is approximately equal to a difference between the given outer diameter of the body portion of said underground pipe and the outer diameter of the fitting portion thereof.

4. A connecting construction according to claim 1, wherein each projecting line formed on said collar has a triangularly shaped cross section.

5. A connecting construction according to claim 1, wherein a total cross sectional area of all the projecting lines formed on said collar body is within a range of 6 to 20% of a total cross sectional area of said collar.

6. A connecting construction according to claim 1, wherein the plurality of projecting lines formed on said collar is approximately 50 or less in number when counted in the circumferential direction of said collar.

7. A connecting construction according to claim 1, wherein each projecting line formed on said collar has a projecting height gradually decreasing toward one end thereof.

8. A connecting construction according to claim 1, wherein the plurality of projecting lines are formed discontinuously in an axial direction of said collar, breaks in neighboring projecting lines being offset from each other when viewed in a circumferential direction of said collar.

9. A connecting construction according to claim 1, wherein the plurality of projecting lines disposed on said collar body are formed in such a cross sectional shape, when taken along an axial direction of said collar, which slopes down toward ends thereof with a middle portion projecting upward.

10. A connecting construction according to claim 1, wherein an axially middle portion of said collar is provided with an inwardly projecting protrusion against which the fitting portion, which is fitted in said collar, abuts.

11. A connecting construction according to claim 1, wherein the plurality of projecting lines are formed only on a lower half portion of said collar, an outer surface of an upper half portion thereof protruding outwardly beyond the outer circumferential surface of the body portion of the pipe.

12. An underground pipe for a thrust boring method by which said pipe is thrust one after another through the ground, each connected to another along a thrusting direction while boring a horizontal tunnel through the ground, said underground pipe comprising:

a pipe body;

end portions formed at each end of the pipe body; and a plurality of projecting lines which are formed at least on a lower half portion of the pipe body excluding the end portions, said projecting lines extend one of continuously and discontinuously in an axial direction of the pipe with suitable spacing provided therebetween in a circumferential direction of the pipe.

13. An underground pipe according to claim 12, wherein one end portion of said pipe is provided with an inserting section, another end thereof with a socket section into which the inserting section of another pipe is inserted.

14. An underground pipe according to claim 12, wherein each end portion of said pipe is provided with a socket section, socket sections pipes to be joined together abutting against each other along the thrusting direction, said socket sections being fastened together with a collar.

15. An underground pipe according to claim 12, wherein the projecting lines have a triangularly shaped cross section.

16. An underground pipe according to claim 12, wherein the projecting lines have a circularly shaped cross section.

17. An underground pipe according to claim 12, wherein said projecting lines are formed on both an upper half portion and the lower half portion of the pipe body.

18. An underground pipe according to claim 12, wherein the projecting lines are formed only on the lower half portion of the pipe body.

19. An underground pipe according to claim 12, wherein the projecting lines are discontinuously formed in the axial direction of the pipe, breaks in neighboring projecting lines being offset from each other when viewed in the circumferential direction of the pipe.

* * * * *